US007192192B2

(12) United States Patent
VandenHeuvel et al.

(10) Patent No.: US 7,192,192 B2
(45) **Date of Patent: *Mar. 20, 2007**

(54) CLOSURE ARRANGEMENT WITH TEAR GUIDE FOR ALLOWING ACCESS TO ZIPPER FLANGES IN A PACKAGE

(75) Inventors: Greg J. VandenHeuvel, Kaukauna, WI (US); Greg W. Melchoir, Green Bay, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 402 days.

This patent is subject to a terminal disclaimer.

(21) Appl. No.: 10/639,045

(22) Filed: Aug. 11, 2003

(65) Prior Publication Data

US 2004/0031132 A1 Feb. 19, 2004

Related U.S. Application Data

(63) Continuation-in-part of application No. 10/131,852, filed on Apr. 25, 2002, now Pat. No. 6,709,157.

(51) Int. Cl.
*B65D 33/16* (2006.01)
*B65D 33/00* (2006.01)
*A44B 19/00* (2006.01)

(52) U.S. Cl. ..... 383/65; 383/63; 383/204; 24/585.12

(58) Field of Classification Search ..... 383/63, 383/65, 59, 5, 204, 210, 211, 61.2; 24/30.5 R, 24/585.12

See application file for complete search history.

(56) References Cited

U.S. PATENT DOCUMENTS 3,565,147 A 2/1971 Ausnit
4,923,309 A * 5/1990 VanErden ..... 383/5
4,941,238 A 7/1990 Clark
RE33,674 E 8/1991 Uramoto
5,067,822 A 11/1991 Wirth et al.
5,335,997 A * 8/1994 Kanemitsu et al. ..... 383/63
5,366,294 A * 11/1994 Wirth et al. ..... 383/210.1
5,470,156 A 11/1995 May
5,503,856 A * 4/1996 Hustad et al. ..... 426/108
5,527,112 A 6/1996 Dais et al.
5,552,202 A 9/1996 May
5,613,934 A 3/1997 May
5,660,479 A 8/1997 May
5,664,303 A * 9/1997 Johnson ..... 24/585.12
5,718,024 A 2/1998 Robbins (Continued)

FOREIGN PATENT DOCUMENTS

EP 0 547 966 A1 * 6/1993 ..... 383/65

*Primary Examiner*—Jes F. Pascua

(57) ABSTRACT

A closure arrangement for a reclosable polymeric bag is disclosed, the closure arrangement comprising convex and concave areas that facilitate opening the bag. To initially open the bag, first and second films are separated from each other by tearing perforations. Next, interlocked closure profiles are detached from each other by grabbing onto gripper ridges and pulling the opening of the bag apart. If the first or second film becomes tucked into the groove left by the perforations such that the gripper ridges are difficult to access even after tearing the perforations, then the end of the opening may be flexed up or down, thereby causing separation of the convex area and concave area to provide access to the gripper ridges.

10 Claims, 6 Drawing Sheets

U.S. PATENT DOCUMENTS 6,047,450 A * 4/2000 Machacek et al. ..... 24/399
6,131,248 A 10/2000 Tomic
6,182,337 B1 2/2001 Machacek et al.
6,481,890 B1 11/2002 VandenHeuvel
6,709,157 B2 * 3/2004 VandenHeuvel et al. .... 383/204

* cited by examiner

CLOSURE ARRANGEMENT WITH TEAR GUIDE FOR ALLOWING ACCESS TO ZIPPER FLANGES IN A PACKAGE

CROSS-REFERENCE TO RELATED APPLICATION

The present application is a continuation-in-part of U.S. patent application Ser. No. 10/131,852, filed on Apr. 25, 2002 now U.S. Pat. No. 6,709,157.

FIELD OF THE INVENTION

The present invention relates generally to opening/closure arrangements for polymeric (plastic) packages and more particularly to a tear guide arrangement for opening a package from a sealed condition.

BACKGROUND OF THE INVENTION

In many consumer packaging applications, it is important to prevent air or water or the like from passing out of or into a package containing certain food products. This is particularly true with respect to cheese packages, meat packages, and the like, for which the contained product must be kept in a constant environment to prevent spoilage. In order to preserve the product contained within such a package, the periphery of the package must be hermetically sealed. Hermetic seals can be provided by both permanent seals and temporary seals known as peelable seals. Peelable seals are capable of providing a hermetic seal and, at the same time, providing a consumer with access to the contents of a package. A consumer breaks a peelable seal of a package by first grabbing onto opposing film faces to which peelable seal materials are adhered and then pulling the film faces apart.

It is also desirable to provide a convenient and effective way to reseal the package after it has been opened. In this respect, reclosable zipper seals are advantageous. On the other hand, reclosable seals alone provide an opportunity for undesired tampering with the contents of a package. To reduce the opportunity for undetected tampering, packages with reclosable zippers can be permanently sealed above or below the reclosable zipper in such in manner that the opening of the package becomes apparent.

However, seals that inhibit tampering may be difficult for the consumer to open. Such seals may require the consumer to break the seals by cutting them with scissors or a knife. To overcome this problem, a perforated tear guide can be combined with a reclosable zipper to provide a package that is easy for the consumer to open and reseal while minimizing the opportunities for undetected pre-sale product tampering.

In many product markets, it is common to use a thermoform packaging machine to package a product. The film for this type of packaging has a tacky sealant layer on its inner side. When two webs of film are brought together, the product and closure arrangement are sealed into the film. The film is also sealed to itself in one or more areas, thereby creating a peelable bond. The outer end of the closure arrangement is then perforated to allow for the end to be removed and to allow access to the zipper or seal. Existing tear guides and closure arrangements are inadequate because the film often gets tucked or sealed into the groove made by the perforation wheel. When this happens, it is difficult to grasp each side of the bag to open the locks of the zipper and ultimately to peel the seal to access the product.

A need therefore exists for a tear guide and closure arrangement for a polymeric package that overcomes the aforementioned shortcomings associated with existing tear guides and closure arrangements.

SUMMARY OF THE INVENTION

Accordingly, the invention described in this application is directed to a reclosable bag comprising convex and concave areas that interact to facilitate opening the bag. To initially open the bag, first and second films are separated from each other by tearing perforations. Next, interlocked closure profiles are detached from each other by grabbing onto gripper ridges and pulling the opening of the bag apart. If the first or second film becomes tucked into the groove left by the perforations such that the gripper ridges are difficult to access even after tearing the perforations, then the end of the opening may be flexed up or down, thereby causing the convex area and concave area to separate and provide access to the gripper ridges.

In an alternate embodiment of the invention, two sets of interlocked closure profiles are initially formed joined to each other and the webs of film attached to each of the pair of interlocked closure profiles. Once the webs of film have been attached to the closure profiles, the pair of interlocked closure profiles are separated along a center slit line such that two packages can be simultaneously formed each utilizing the closure arrangement of the present invention.

BRIEF DESCRIPTION OF THE DRAWINGS

While the specification concludes with claims specifically pointing out and distinctly claiming the subject matter of the invention, it is believed the invention will be better understood from the following description taken in conjunction with the accompanying drawings wherein like reference characters designate the same or similar elements and wherein:

DETAILED DESCRIPTION OF THE PREFERRED EMBODIMENT

Figure 1:
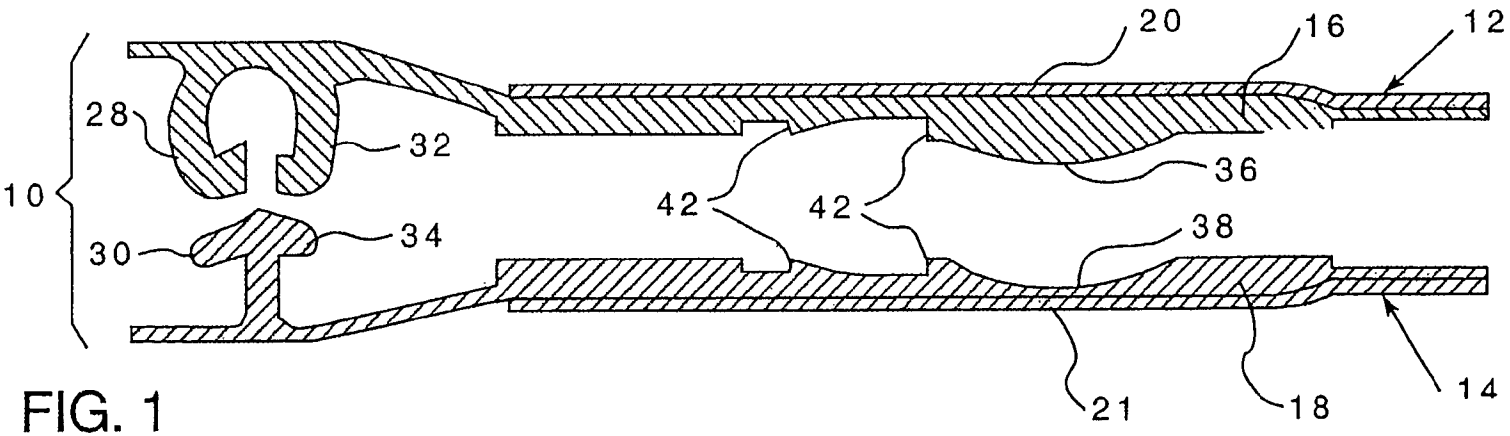
FIG. 1 is a sectional view of one embodiment of the present invention, showing an unmated zipper profile and an open concave/convex arrangement.
Figure 2:
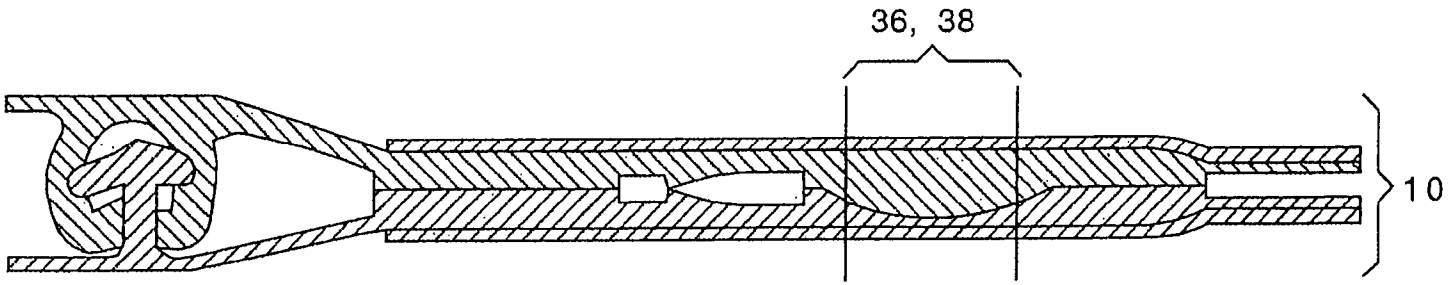
FIG. 2 is a sectional view of the closure arrangement in FIG. 1, wherein the zipper profile is mated and the concave/convex portions are mated.

With reference to FIGS. 1 and 2, a cross-sectional view of a partial closure arrangement 10 for a polymeric reclosable bag is shown. The closure arrangement 10 comprises a first header 12 having an inner layer 16, and a second header 14 having an inner layer 18. Both the first header 12 and the second header 14 also include outer sealant layers 20, 21. The closure arrangement 10 is preferably disposed at the mouth of a reclosable bag and extends along the length of the bag mouth (not shown).

Figure 3:
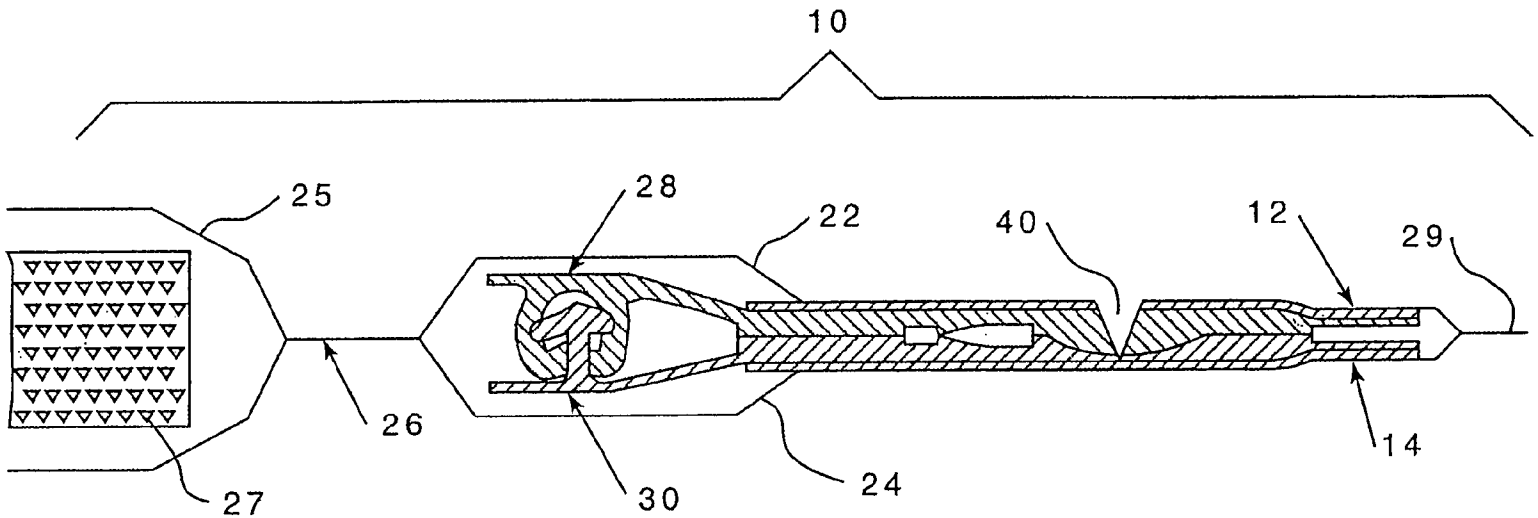
FIG. 3 is a sectional view of the closure arrangement in FIG. 1 incorporated into a reclosable bag showing a peel seal located between the bag and the closure arrangement and perforation groove in the holder portion of the closure arrangement.

As shown in FIG. 3, a first film 22 is preferably attached (e.g heat-fused) to the first header 12, and a second film 24 is attached to the second header 14. The films 22, 24 will preferably have a peelable seal 26 disposed between them as a feature of the overall closure arrangement 10. The peel seal is preferably located between the interlocking profiles 28, 30 and the bag 25 and its contents 27. In another embodiment, the peel seal 26 is located between the interlocking profiles 28, 30 and the top or mouth end 29 of the bag.

In a preferred embodiment the closure arrangement 10 includes a reclosable zipper. With reference to FIGS. 1 and 2 the inner layers 16, 18 preferably include integrally formed female 28 and male 30 closure profiles. For example, the female closure profile 28 may extend inwardly from the first inner layer 16 and include a pair of flexible locking members 32 with hooks at the ends thereof The male closure profile 30 preferably extends inwardly from the opposite/second inner layer 18 and includes a single locking member 34 with an expanded head. The pair of locking members 32 are disposed opposite the single locking member 34 and are spaced by a sufficient distance that the expanded head of the single locking member 34 is releasably engageable between the pair of locking members 32. More specifically, the pair of locking members 32 interlock with the locking member 34 in a snapping action caused by bringing the hooks of the pair of locking members 32 past the expanded head of the locking member 34.

As shown in FIGS. 1 and 2, the first inner layer 16 preferably includes a convex area 36, and the second inner layer 18 preferably includes a concave area 38 at a corresponding location such that the convex area 36 mates with the concave area 38 when the first header 12 and second header 14 are engaged and the bag is closed. The inner layers 16, 18 each include one or more gripper ridges 42 to facilitate the gripping and peeling apart of the first header 12 and second header 14.

As shown in FIG. 3, prior to initially opening a bag incorporating the closure arrangement 10, the peelable seal 26 is intact, the closure profiles 28, 30 are interlocked with each other, and the first and second films 22, 24 are preferably connected at the mouth end 29 of the bag. To facilitate opening, a preferential area of weakness 40 may be incorporated into the first header 12 exterior to the convex area 36, or into the second header 14 exterior to the concave area 38, or into both (not shown). The preferential area of weakness 40 may be created with perforations, a knife score, a stress line or a laser score. As shown, the first and second films 22, 24 may be either heat-fused together at the mouth end 29 of the bag or may be formed from a single piece of film. Since the peelable seal 26 already provides a hermetic seal for the bag, the first and second films 22, 24 at the mouth end 29 may alternatively be disconnected from each other.

Figure 4:
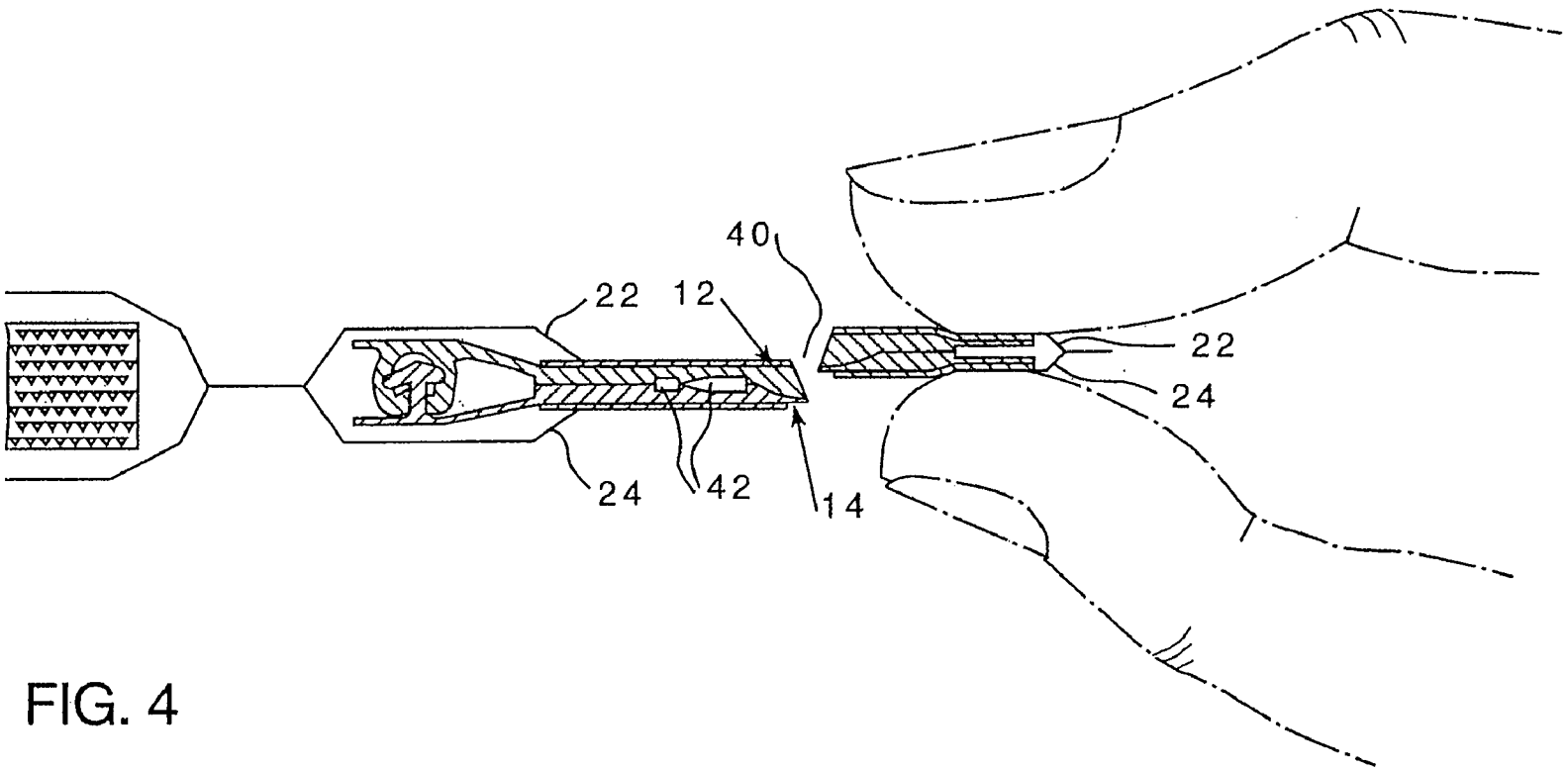
FIG. 4 is a sectional view of the closure arrangement and reclosable bag in FIG. 3 wherein the tip of the closure arrangement is removed to provide access to the contents of the reclosable bag.
Figure 5:
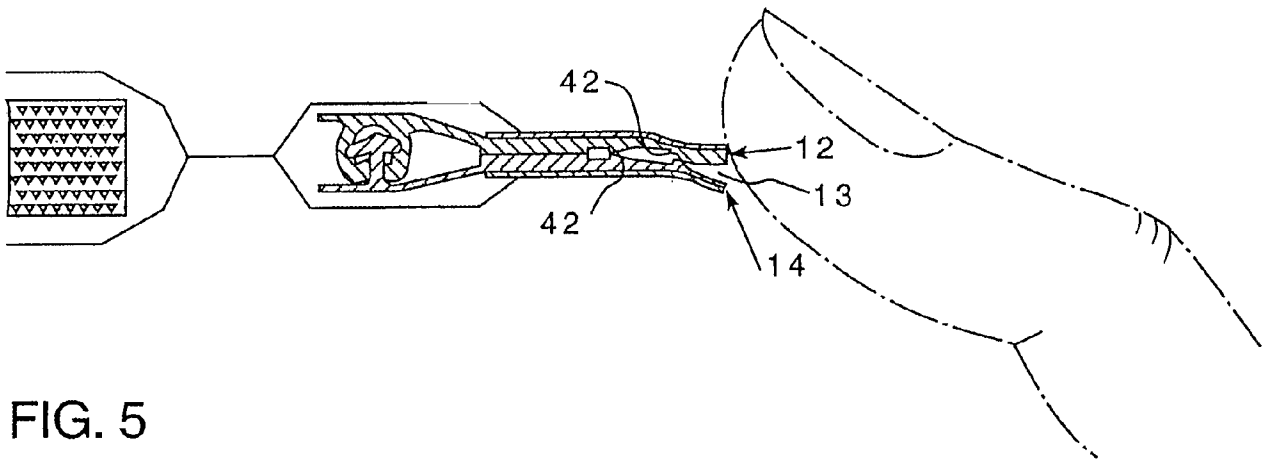
FIG. 5 is a sectional view of the closure arrangement and reclosable bag in FIG. 4 after removal of the tip and showing the separation forces generated by flexing the tip in one direction or another.
Figure 5A:
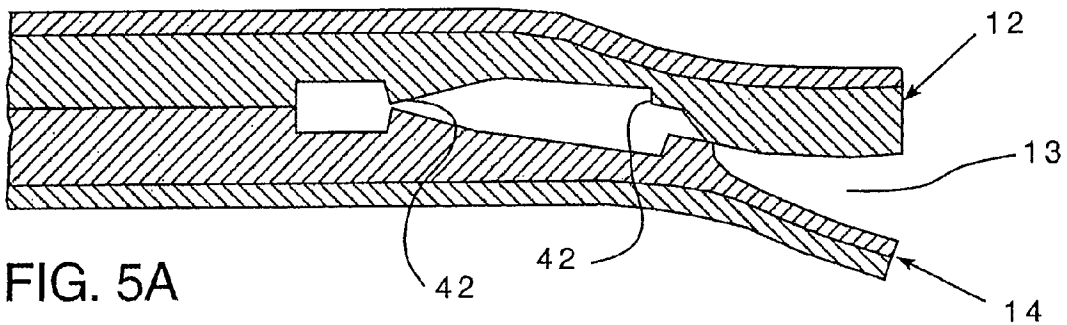
FIG. 5A is a close-up view of the closure arrangement in FIG. 5.
Figure 6:
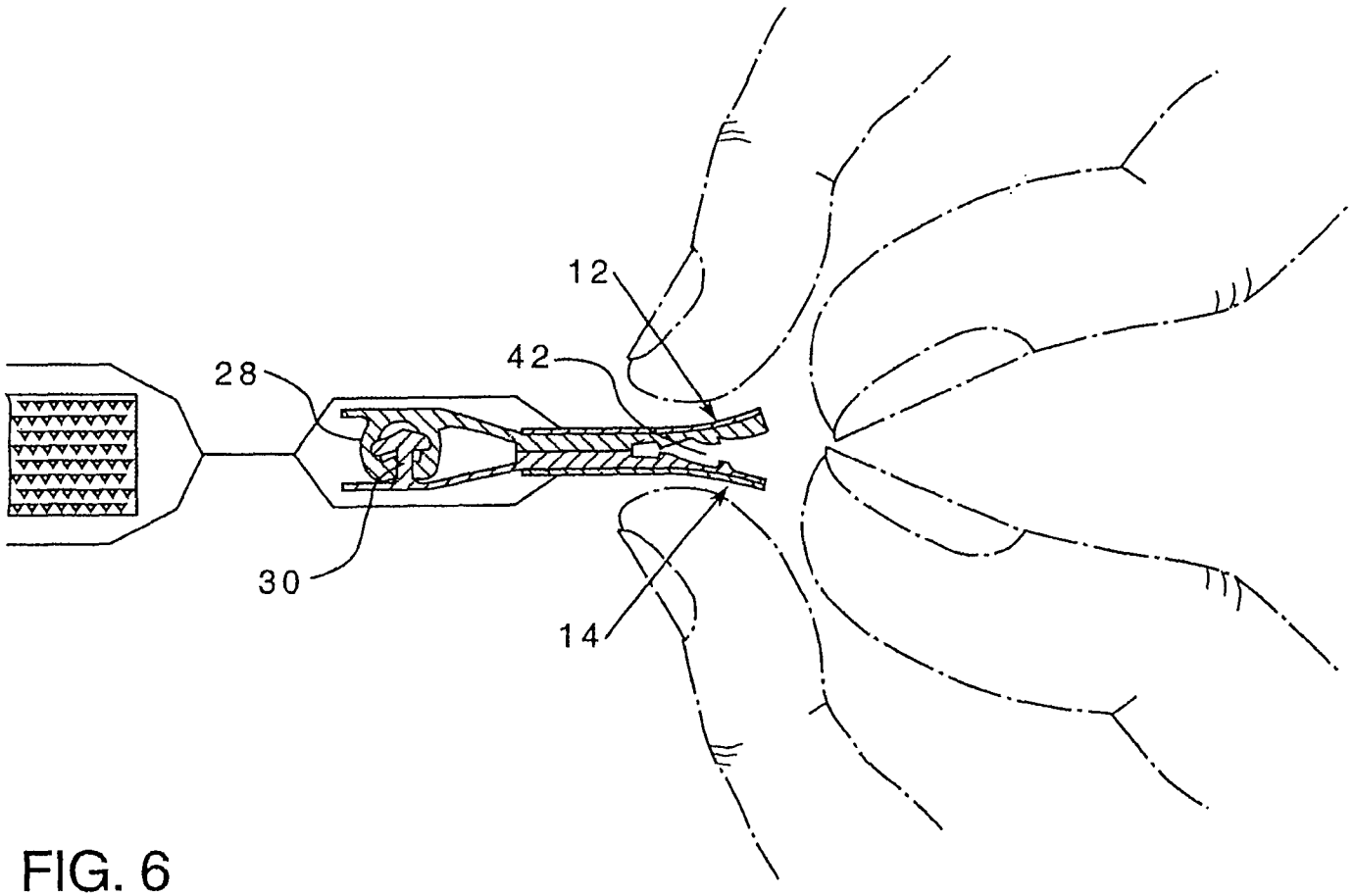
FIG. 6 is a sectional view of the closure arrangement and reclosable bag in FIG. 5 showing access to the gripper ridges.

As shown in FIG. 4, to open the bag, the first and second films 22, 24 are separated from each other by tearing the preferential area of weakness 40. However, sometimes the first film 22 or second film 24 becomes tucked into the groove left by the preferential area of weakness 40 such that the gripper ridges 42 are difficult to access after tearing the preferential area of weakness 40. In such cases, the first header 12 and second header 14 may be jointly flexed up or down as shown in FIGS. 5 and 5A. This action causes the convex area 36 and concave area 38, by virtue of their corresponding shapes and locations, to separate from each other to create an opening 13, thereby providing access to the gripper ridges 42. As shown in FIG. 6, the interlocked closure profiles 28, 30 may be detached from each other by grabbing onto the gripper ridges 42 and pulling the first header 12 and second header 14 apart. The interlocked closure profiles 28, 30 and peelable seal 26 are then separated by continuing to separate the first header 12 and second header 14 in opposite directions.

Figure 7:
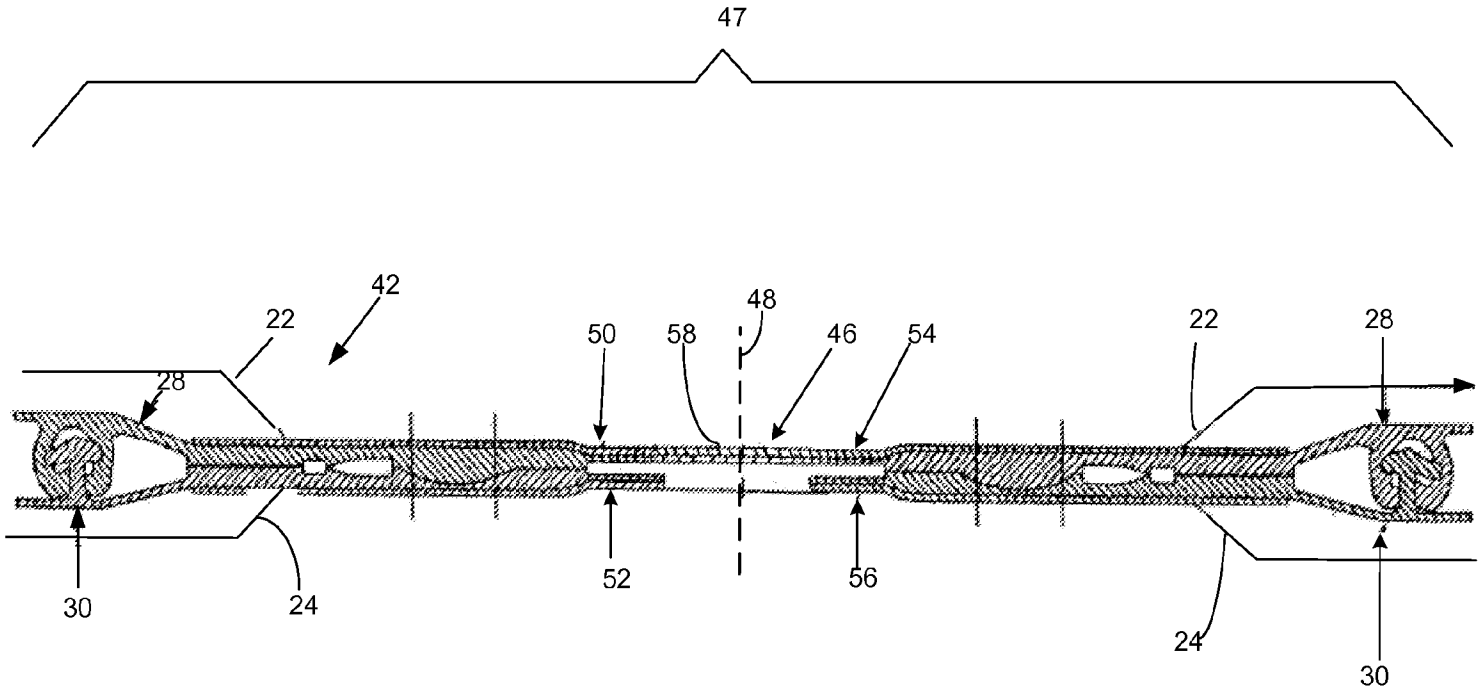
FIG. 7 is a sectional view of a pair of closure arrangements joined to each other wherein the zipper profiles are mated and the concave/convex portions of each closure arrangement are also mated.

As shown in FIG. 7, in an alternate embodiment of the invention, a first closure arrangement 42 and a second closure arrangement 44 can be mated to each other along a center section 46 such that the two closure arrangements define a dual closure arrangement 47. The first closure arrangement 42 includes a first header 50 and a second header 52, while the second closure arrangement 44 includes a third header 54 and a fourth header 56. The headers 50–56 are similar to the headers 12, 14 defined in the previous embodiment of the invention.

As shown in FIG. 7, the first film 22 is preferably attached (e.g. heat-fused) to the first header 50 of the first closure arrangement 42 and the third header 54 of the second closure arrangement 44. Additionally, the first film 22 is also attached to a connecting portion 58 joining the pair of headers 50, 54. The second film 24 is attached to the second header 52 of the first closure arrangement 42 and the fourth header 56 of the second closure arrangement 44. The second film 24 bridges the opening between the headers 52, 56 as illustrated.

After the first and second films 22, 24 have been attached to the dual profile arrangement shown in FIG. 7, the first closure arrangement 42 and the second closure arrangement 44 are separated along a slit line 48. Once the closure arrangements 42, 44 have been separated, each of the packages generally takes the form shown in FIG. 3. As previously described with reference to FIG. 3, a peelable seal 26 provides a hermetic seal for the bag such that the first and second films 22, 24 at the mouth end of the bag can be disconnected from each other.

Once the dual profile arrangement 47 shown in FIG. 7 has been separated, a pair of bags each includes one of the unique closure arrangements of the present invention and can be opened in the manner previously described.

Although the invention has been described in terms of particular embodiments in an application, one of ordinary skill in the art, in light of the teachings herein, can generate additional embodiments and modifications without departing from the spirit of, or exceeding the scope of, the claimed invention. Nothing in the above description is meant to limit the present invention to any specific materials, geometry, or orientation of elements. Many part/orientation substitutions are contemplated within the scope of the present invention and will be apparent to those skilled in the art. Accordingly, it is understood that the drawings, descriptions and examples herein are proffered only to facilitate comprehension of the invention and should not be construed to limit the scope thereof.

What is claimed is:

1. A dual closure arrangement for use on a pair of separate polymeric bags, the dual closure arrangement comprising:

a first closure arrangement including a first reclosable fastener, a first header portion with an interior convex area and a second header portion with an interior concave area located opposite the interior convex area of the first header portion;

a second closure arrangement including a second reclosable fastener, a third header portion with an interior convex area and a fourth header portion with an interior concave area located opposite the interior convex area of the third header portion, wherein the first header portion is joined to the third header portion such that the first closure arrangement and the second closure arrangement are connected to each other, and one or more gripping ridges disposed on both the first header portion and the third header portion, wherein the gripping ridges are positioned between the convex area and the reclosable fastener of each of the first and second closure arrangements.

2. The dual closure arrangement of claim 1, wherein the first header portion and the third header portion each include a preferential area of weakness exterior to the convex area.

3. The dual closure arrangement of claim 2, wherein said the preferential area of weakness is selected from the group consisting of a perforation, a knife score, a stress line or a laser score.

4. The dual closure arrangement of claim 1, wherein the first header portion and the third header portion each contain a preferential area of weakness exterior to the convex area along a line that is parallel to the reclosable fastener.

5. The dual closure arrangement of claim 1, further comprising a peel seal disposed between the reclosable fastener of the first closure arrangement and an interior of the bag and a second peel seal disposed between the reclosable fastener of the second closure arrangement and an interior of the bag.

6. A method for making a pair of sealed polymeric bags, comprising:

providing a dual profile having a first closure arrangement and a second closure arrangement joined to each other;

sealing a first header portion of the first closure arrangement inside a first film, the first header portion having a convex area;

sealing a third header portion of the second closure arrangement inside the first film, the third header portion having a convex area;

sealing a second header portion of the first closure arrangement inside a second film, the second film the second header portion having a concave area opposite the convex area of the first header portion;

sealing a fourth header portion of the second closure arrangement inside the second film, the fourth header portion having a concave area opposite the convex area of the third header portion;

providing one or more gripping ridges disposed on both the first header portion and the third header portion, wherein the gripping ridges are positioned between the convex area and the reclosable fastener of each of the first and second closure arrangements, and separating the first closure arrangement from the second closure arrangement to define two separate sealed polymeric bags.

7. The method of claim 6 wherein the first header portion is connected to the third header portion prior to separation of the first closure arrangement from the second closure arrangement.

8. The method of claim 6 wherein each of the first, second, third and fourth header portions contain one or more gripping ridges.

9. The method of claim 6 further comprising the step of perforating the first header portion exterior to the convex area and perforating the third header portion exterior to the convex area.

10. The method of claim 6, further comprising the step of perforating the second header portion exterior to the concave area and perforating the fourth header portion exterior to the concave area.

* * * * *